US006942587B2

(12) United States Patent
Lussier et al.

(10) Patent No.: US 6,942,587 B2
(45) Date of Patent: Sep. 13, 2005

(54) HOLLOW WOODEN HOCKEY STICK

(75) Inventors: Remi Lussier, Drummondville (CA); Marcel Jean, Drummondville (CA); Daniel Gatien, Drummondville (CA)

(73) Assignee: 2946-6380 Quebec Inc. (CA)

( * ) Notice: Subject to any disclaimer, the term of this patent is extended or adjusted under 35 U.S.C. 154(b) by 0 days.

(21) Appl. No.: 10/700,944

(22) Filed: Oct. 31, 2003

(65) Prior Publication Data

US 2004/0089416 A1 May 13, 2004

Related U.S. Application Data

(63) Continuation of application No. 09/707,406, filed on Nov. 7, 2000, now Pat. No. 6,702,697.

(51) Int. Cl.[7] ..... A63B 59/14
(52) U.S. Cl. ..... 473/561
(58) Field of Search ..... 473/560–563, 473/FOR 184

(56) References Cited

U.S. PATENT DOCUMENTS

| | | | | |
|---|---|---|---|---|
| 4,159,114 A | | 6/1979 | Ardell et al. | |
| 4,600,192 A | | 7/1986 | Adachi | |
| 5,217,221 A | | 6/1993 | Baum | |
| 5,636,836 A | | 6/1997 | Carroll et al. | |
| 5,879,250 A | | 3/1999 | Tahtinen et al. | |
| 6,702,697 B1 | * | 3/2004 | Lussier et al. | 473/561 |
| 2002/0037780 A1 | | 3/2002 | York et al. | |

FOREIGN PATENT DOCUMENTS

| | | | |
|---|---|---|---|
| CA | 17196 | | 4/1907 |
| CA | 544992 | | 8/1957 |
| CA | 896690 | | 3/1972 |
| CA | 914232 | | 11/1972 |
| CA | 1066319 | | 11/1979 |
| CA | 1069147 | | 1/1980 |
| CA | 1069957 | | 1/1980 |
| CA | 1151693 | | 8/1983 |
| CA | 1180728 | | 1/1985 |
| CA | 1183883 | | 3/1985 |
| CA | 1207350 | | 7/1986 |
| CA | 2189509 | | 5/1998 |
| GB | 7196 | * | 7/1906 |

* cited by examiner

*Primary Examiner*—Mark S. Graham
(74) *Attorney, Agent, or Firm*—Akerman Senterfitt

(57) ABSTRACT

A hockey stick having a longitudinal shaft provided with a longitudinal cavity and a method of construction of such a hockey stick are described herein. The shaft includes a hollow wooden core and a reinforcement layer. The hollow wooden core is advantageously made of two half-cores having a channel provided therein that are assembled face-to-face to yield the hollow wooden core. The reinforcement layer may advantageously include thin reinforcement strips of high modulus fibers and a layer of fiberglass fabric.

6 Claims, 5 Drawing Sheets

HOLLOW WOODEN HOCKEY STICK

FIELD OF THE INVENTION

The present invention relates to hockey sticks. More specifically, the present invention is concerned with a hockey stick provided with a generally hollow wooden shaft.

BACKGROUND OF THE INVENTION

Ice hockey sticks are well known in the art. They are usually made up of two parts: a straight elongated shaft, rectangular in cross-section and a blade mounted at the distal end, or heel, of the shaft. A reinforcing high modulus light weight fabric is wrapped under the blade and covers the two faces of the blade as well as the distal portion of the shaft.

The cross-sectional dimensions of the ice hockey shaft have not changed much over the years as they were governed originally by the necessity for the player to have a good grip on the shaft in particular to prevent undesired rotation of the shaft.

The four axial apex or corners of the hockey stick shaft are usually rounded in order to provide comfort for the hands of the player while maintaining a good grip thereon. The hockey stick shaft is advantageously uniform in cross-section along its length until about 11 inches (about 0.28 m) from the heel where there is a taper to provide a smooth engagement therewith.

The shaft has conventionally been made of solid heavy hardwoods such as, for example, white ash or birch. These hardwood shafts usually require no reinforcement. They are advantageously glued to a one piece blade of the same type of wood, the blade alone being reinforced with a single layer of light woven fibreglass fabric covering the under blade and the two wider faces of the blade on the outside.

Such conventional hockey stick made of white ash which has an average density of 0.65 grams per cubic centimeters will weight, on average, about 700 g.

Players are often looking for lighter weight hockey sticks that do not sacrifice the stiffness and the resistance of the shaft to breakage.

Since little can be done to reduce the weight of the blade which represent a small percentage of the total weigth of the hockey stick, the efforts to reduce the weight of the hockey stick are usually directed to the shaft.

Many techniques have been proposed to reduce the weight of the hockey stick shaft. For example, the application of unidirectional fibreglass resin thin strips glued or moulded directly along the two wide sides of the hockey shaft in association with the use of a solid low density wooden core, such as, for example, aspen allowed the reduction of the weight of the hockey stick. This technique is disclosed in Canadian Patent No 1,151,693 issued on Aug. 9, 1983 to Goupil et al. In this patent, the wooden core, which can be made of solid and relatively light hardwood such as Ramin, is reinforced with fibreglass. This hardwood is lighter and less expensive than the conventional northern white ash, or birch solid wood or laminated wood that is conventionally used. Another method consists in using a very light hardwood such as aspen or poplar for a solid core, reinforcing the two wider opposite surfaces with a layer of high modulus fibre such as glass and carbon fibres. It also comprises rigid binding resin which has resulted in the production of relatively light weight and stiff handle at low cost. This technique has been very popular on the markets for many years.

Another technique used to produce a lightweight but stiff shaft in a hockey stick, possessing a supporting axial core made of hardwood, is to provide one or more transversal or axial cavities in various shape, size and position relative to the outside surface of the shaft and then to reinforce the shaft with aircraft plywood, fibreglass or a combination of glass and carbon fibres. U.S. Pat. No. 5,879,250 issued to T ähtinen et al. on Mar. 9, 1999 describes such a reinforcement technique. This technique has the significant drawback that since the cavities are open to the external surface of the wooden portion of the shaft, it weakens the shaft and it allows the adhesive used to secure the reinforcement to enter the cavities and to reduce the efficiency of the weight reduction.

One interesting development that proposes to design a hockey stick provided with a hollow central cavity surrounded by various types of medium and high costs plywood, is disclosed in U.S. Pat. No. 4,159,114 issued Jun. 26, 1979 to Ardell et al. The drawback of the hollow core proposed by Ardell is described in this document in column 4, line 37 that states: "the laminated construction of FIG. 13 (with a hollow core) tends to be very strong and light-weight but is also extremely expensive to produce". This high production cost could be due to the fact that creating such an axial hollow core in a hockey stick handle, requires a complicated technology with several production steps.

A similar development, described in Canadian Patent No. 1,180,728 issued Jan. 8 1985 to Michaud, proposes a hollow central cavity partially surrounded with wood. FIG. 2 of this document illustrates a hollow inner shaft portion extending to reach the surface of two layers of fibreglass reinforcement material. As it can be seen in this figure, the hollow section between the wider faces of the body extends to reach the two large opposite sides reinforcements, therefore resulting in sections where the reinforcement alone contributes to the stiffness of the shaft. Hence, it reduces the stiffness of the shaft in the plane of maximum bending of the shaft. Furthermore, it makes the positioning process of the two elongated pieces of wood, between the reinforcing strips, difficult to control, thereby increasing the cost of manufacture of the sticks.

In an attempt to obtain a strong, stiff hockey shaft with reduced weight, hollow shafts of aluminum, composite, hybrids of aluminum and composite, have been developed. These developments have been relatively effective in improving stiffness and strength but have resulted in increasingly expensive hockey sticks.

SUMMARY OF THE INVENTION

In accordance with the present invention, there is provided a hockey stick comprising:

a longitudinal shaft having a proximate end portion, a central portion and a distal end portion; the longitudinal shaft including a generally rectangular wooden core and a reinforcement layer; the wooden core including two half-cores assembled face-to-face; each of the half-core being provided with respective longitudinal channels that define at least one cavity in the central portion of the shaft; and a blade mounted to the distal end of the shaft.

According to another aspect of the present invention, there is provided a method for making the shaft of a hockey stick comprising:

providing two longitudinal rectangular wooden half-cores having a proximate end portion, a distal end portion and a central portion;

for each half-core, machining a channel in at least the central portion thereof;

assembling the machined half-cores face-to-face to thereby yield a hollow wooden core provided with a cavity in at least its central portion;

mounting a reinforcement layer to the hollow wooden core.

Other objects, advantages and features of the present invention will become more apparent upon reading of the following non-restrictive description of preferred embodiments thereof, given by way of example only with reference to the accompanying drawings.

DESCRIPTION OF THE PREFERRED EMBODIMENT

A hollow wooden core hockey stick 20 according to a first embodiment of the present invention will now be described with references to FIGS. 1, 2 and 8.

Figure 2:
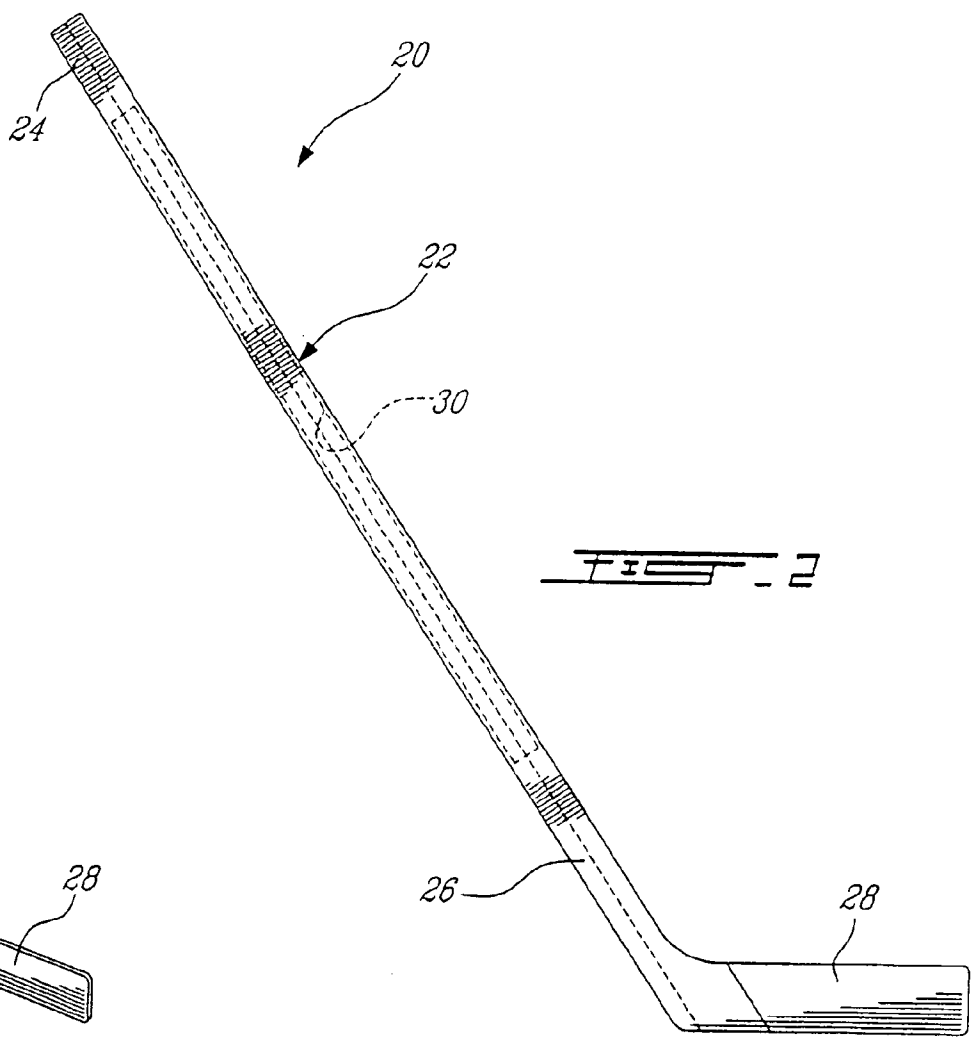
FIG. 2 is a side schematic elevational view of the hockey stick of FIG. 1.
Figure 1:
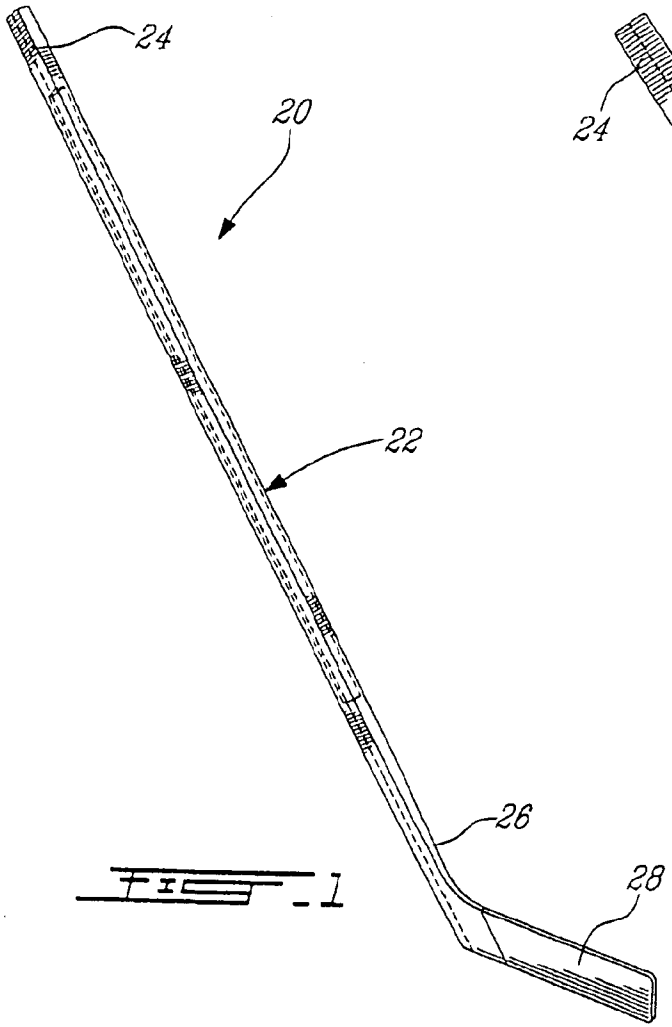
FIG. 1 is a schematic perspective view of a hockey stick according to a first embodiment of the present invention.

As it can be seen in FIGS. 1 and 2, the hockey stick 20 is made of two main parts, i.e., a longitudinal shaft 22 having a proximate end portion 24, a tapering distal end portion 26 and a central portion between the end portions 24 and 26; and a blade 28 mounted to the distal end portion 26 of the shaft 22.

Since the present invention is mainly concerned with the longitudinal shaft 22, the interconnection of the blade 28 with the shaft 22 will not be described in detail herein.

As can be better seen from FIG. 2 of the appended drawings, the shaft 22 includes a cavity 30 extending in the central portion between the proximate end portion 24 and the distal end portion 26.

The cavity 30 is therefore not present in the conventional grip area of the proximate end portion 24 and in the tapering portion where the thickness of the shaft 22 decreases to be streamlined with the blade 28. Of course, depending on the intended use of the hockey stick, the cavity could extend to the proximate end portion 24, for example for younger players that do not need a reinforced grip area.

As will be apparent to one skilled in the art, the purpose of the cavity 30 is to reduce the total weight of the hockey stick 20.

Figure 8:
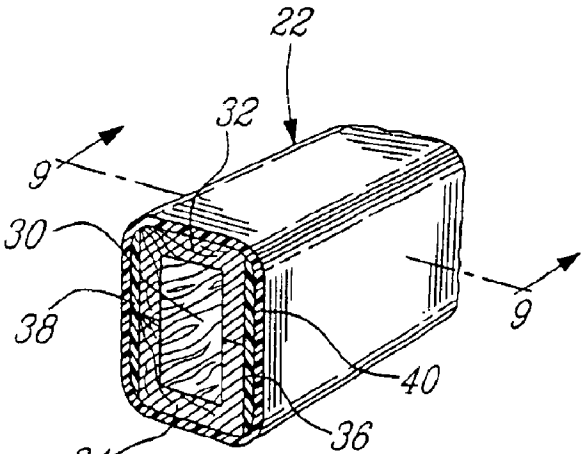
FIG. 8 is a sectional perspective view of the reinforced hollow wooden core provided with a layer of fibreglass fabric applied thereto.
Figure 9:
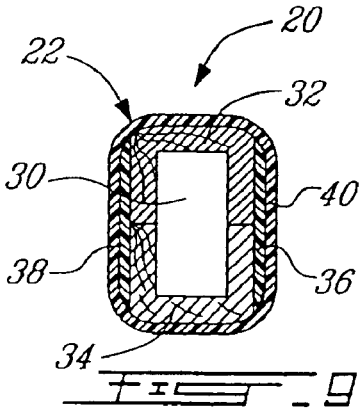
FIG. 9 is a sectional view taken along line 9—9 of FIG. 8.

Turning now more specifically to FIGS. 8 and 9 of the appended drawings, the shaft 22 is made of two identical U-shaped half-cores 32 and 34 that are glued face to face to define a hollow wooden core. The shaft 22 also includes two thin reinforcement strips of parallel axial high modulus fibres, such as, for example, fibreglass fibres, in a matrix of thermoset resin 36 and 38, each secured to the opposite wider parallel outer faces of the hollow wooden core to yield a reinforced hollow wooden core.

Finally, an outer layer of fibreglass fabric 40 covers the reinforced hollow wooden core. The fibreglass fabric 40 could be, for example, bidirectional nonwoven fibreglass roving fabric.

The thin reinforcement strips 36 and 38 and the fibreglass fabric defining a reinforcement layer of the hockey stick 20. Of course, other reinforcement layers could be used.

It is to be noted that the reinforcement strips could be made of other suitable material such as, for example, aircraft grade veneer or plywood. Similarly, the outer layer 40 could also be made of carbon fibres or a combination of carbon fibres and glass fibres, for example.

As it will be understood by one skilled in the art, the grain direction of the wooden core and any other layers made from wood is advantageously parallel to the longitudinal axis of the shaft 22, i.e., from the proximate end portion 24 to the distal end portion 26. Furthermore, the wooden core is advantageously made of wood selected from aspen, poplar and other wood species having a density below 0.50 gcc.

Turning now more specifically to FIGS. 3 to 8, a method of fabrication of the shaft 22 as described hereinabove will be described.

Figure 3:
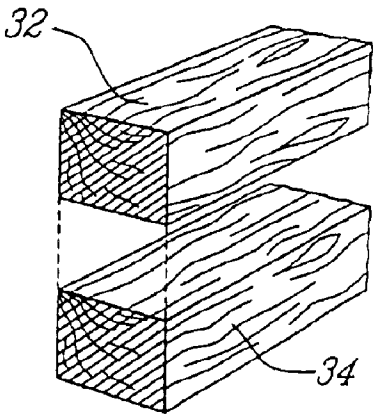
FIG. 3 is a sectional perspective view illustrating two similarly shaped rectangular low density wooden half cores.

FIG. 3 illustrates the two half-cores 32 and 34 before they are machined to yield U-shaped half-cores. The half-cores are made of a suitable wood such as solid aspen and are advantageously prepared so as to have straight planetary gluing surfaces generally perpendicular to the axis of the shaft.

Figure 4:
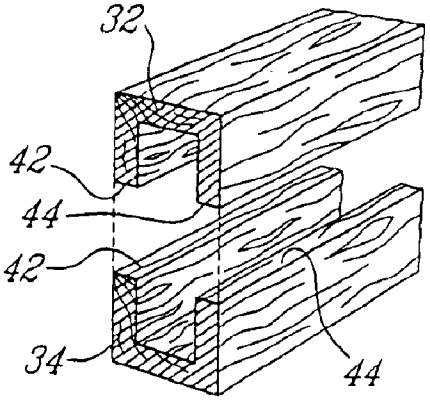
FIG. 4 is a sectional perspective view of the two similarly shaped rectangular low density wooden half cores after they have been machined.

FIG. 4 illustrates the half-cores 32 and 34 after they have been machined to yield U-shaped half-cores. This machining step, consisting in providing a rectangular groove in each half-core, may be done, for example, by a shaper or a saw that allows the U-shape to be provided only in the central portion of the half-cores, to thereby allow the proximate and distal end portions to be solid.

Figure 5:
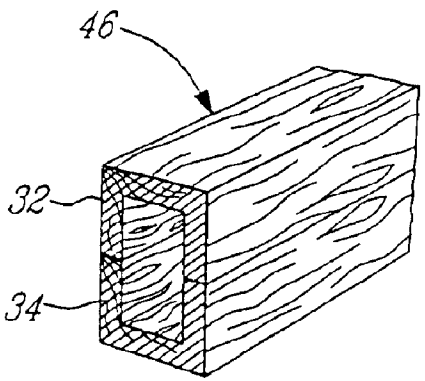
FIG. 5 is a sectional perspective view of the two machined half-cores when assembled to form a hollow wooden core.

The U-shape of the half-cores 32 and 34 yields two flat gluing surfaces 42 and 44 on each core. An appropriate adhesive, for example wood glue based on liquid urea formaldehyde, is used to secure the two half-cores 32 and 34 face to face to yield a hollow wooden core 46 (FIG. 5).

Figure 6:
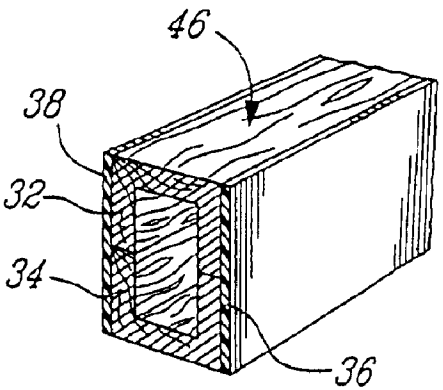
FIG. 6 is a sectional perspective view of the hollow wooden core provided with a thin strip reinforcement of parallel axial high modulus fibres in a matrix of thermoset resin secured to the two wide parallel outer faces to yield a reinforced hollow wooden core.
Figure 7:
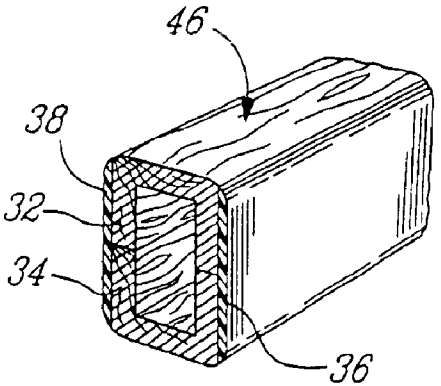
FIG. 7 is a sectional perspective view of the reinforced hollow wooden core when the corners have been rounded.

The next step in the manufacture of the shaft 22 is to secure thin strips of parallel axial high modulus fibres in a matrix of thermoset resin 36 and 38 to the two wider parallel outer faces of the hollow wooden core 46 via a suitable adhesive such as, for example, liquid epoxy resin. The purposes of the strips 36 and 38 consist in improving the stiffness of the shaft 22 and to reinforce the joints between the two half-cores 32 and 34. The result of this step is illustrated in FIG. 6.

The reinforced hollow wooden core is then machined to round the corners thereof to thereby provide a more comfortable shaft.

The final optional step, as shown in FIG. 8, is to apply a fibreglass fabric 40 to the reinforced hollow wooden core in order to provide additional reinforcement and to provide interesting tactile qualities to the finished shaft. Indeed, as will easily be understood by one skilled in the art, some hockey sticks do not require an outer layer of fabric, for example, hockey sticks that are intended to be used by young players do not necessarily need further reinforcement.

FIG. 9 is a sectional view taken along line 9—9 of FIG. 8 and illustrates the various elements of the hockey stick 20.

As will easily be understood by one skilled in the art, by providing a hockey stick shaft made of two half-cores that are machined to include a longitudinal channel and by gluing these two half-cores together, the overall complexity and costs of manufacture are decreased since conventional wood working machinery may be used. Furthermore, since the cavity is completely enclosed by wood, the structural integrity of the shaft is maintained and the cavity is not filled by the adhesive used to secure the reinforcement strips to the hollow wooden core.

Turning now to FIGS. 10 to 14 of the appended drawings, various arrangements of wooden cores and of reinforcement layers will be described. These figures are sectional views similar to FIG. 9. It is to be noted that only the differences between the embodiments of the present invention illustrated in FIGS. 10 to 14 and the first embodiment illustrated in FIGS. 1 to 9 will be described hereinbelow for concision purposes. Similarly, one skilled in the art should be in a position to modify the construction method described hereinabove according to the various embodiments.

Figure 10:
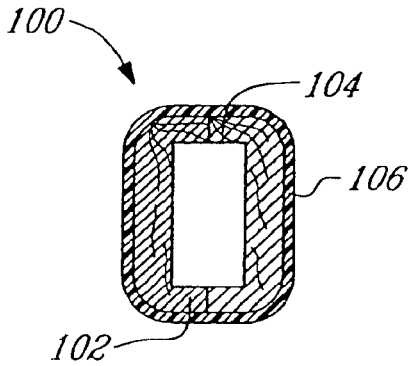
FIG. 10 is a sectional view, similar to FIG. 9, illustrating a hockey stick according to a second embodiment of the present invention.

FIG. 10 illustrates a hockey stick 100 where the two identical U-shaped half-cores 102 and 104, that are glued face to face to define a hollow wooden core, have their interconnection on the narrow surfaces of the hockey stick 100. The stick 100 does not includes the two thin reinforcement strips found on the hockey stick 20 (see numeral 36 and 38). An outer layer of fibreglass fabric 106 covering the hollow wooden core is however present.

Figure 11:
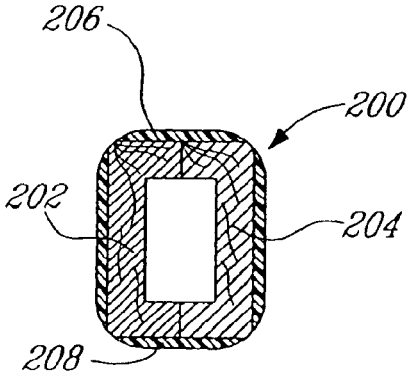
FIG. 11 is a sectional view, similar to FIG. 9, illustrating a hockey stick according to a third embodiment of the present invention.

In FIG. 11, the hockey stick 200 also has two identical U-shaped half-cores 202 and 204 that are so glued face to face to define a hollow wooden core where the interconnections of the two half-cores are on the narrow surfaces of the hockey stick 200. Two supplemental reinforcement strips 206 and 208 are provided on the narrow opposite faces of the hollow core to reinforce the joint between the half-cores. However, the hockey stick 200 does not include an outer layer of fibreglass fabric such as outer layer 40 of hockey stick 20 (see FIG. 9).

Figure 12:
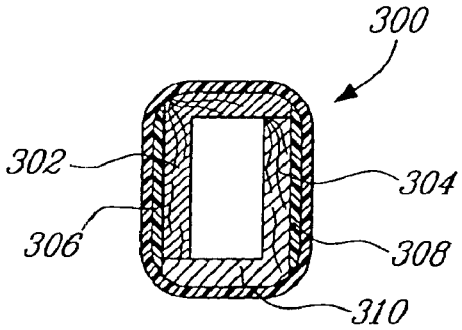
FIG. 12 is a sectional view, similar to FIG. 9, illustrating a hockey stick according to a fourth embodiment of the present invention.

FIG. 12, on the other hand, illustrates a hockey stick 300 where the two half-cores 302 and 304 are L-shaped where the interconnections between the half-cores are provide on the wider faces of the hollow core. Again, reinforcement strips 306 and 308 and an outer layer 310 are provided.

Figure 13:
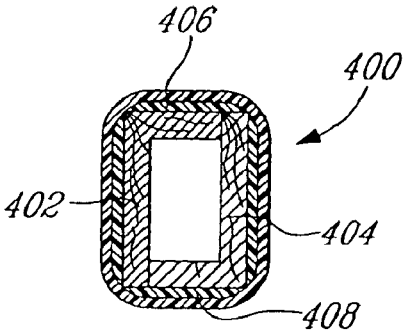
FIG. 13 is a sectional view, similar to FIG. 9, illustrating a hockey stick according to a fifth embodiment of the present invention.

FIG. 13, which is very similar to FIG. 12, illustrates a hockey stick 400 where the L-shaped half-cores 402 and 404 are interconnected on the narrow faces of the thus formed hollow core. Furthermore, additional reinforcement strips 406 and 408 are provided on the narrow faces of the hollow core to reinforce the interconnections between the half-cores. It is to be noted that these additional reinforcement strips 406 and 408 could be omitted.

Figure 14:
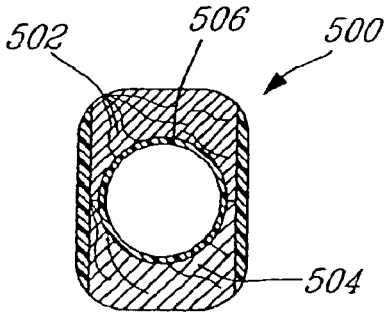
FIG. 14 is a sectional view, similar to FIG. 9, illustrating a hockey stick according to a sixth embodiment of the present invention.

FIG. 14 illustrates a hockey stick 500 where the half-cores 502 and 504 are each provided with a semi-cylindrical channel to define a hollow core provided with a cylindrical longitudinal cavity. To decrease the weight of the wood, the semi-cylindrical channels leave a relatively thin wood wall. To ensure the integrity and increase the stiffness of the wooden core, a thin cylindrical tube is glued in the channels of the half cores 504 and 504. This thin tube may be made of high modulus fibres such as fibreglass or carbon fibres. Of course, the tube 506 is glued to the half-cores during the assembly of the wooden core.

It is also to be noted that the hockey stick 500 does not include an outer layer of fibreglass fabric such as outer layer 40 (see, for example FIG. 9).

As will be apparent to one skilled in the art, such an internal reinforcement feature could be included in the other embodiments described herein.

FIGS. 9 to 14 illustrate that the reinforcement layer may be customized depending of the degree of stiffness required from the hockey stick, for example.

Figure 16:
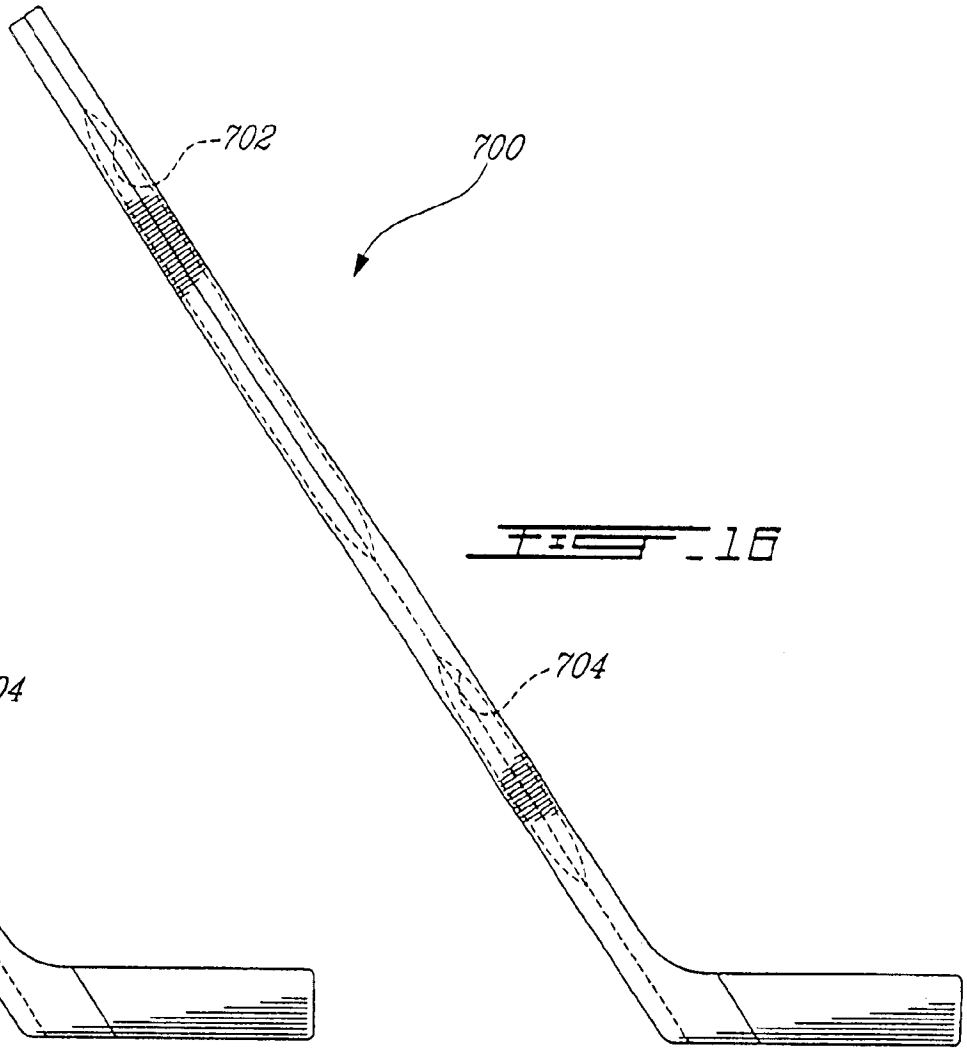
FIG. 16 is a schematic side elevational view of a hockey stick according to a eighth embodiment of the present invention.
Figure 15:
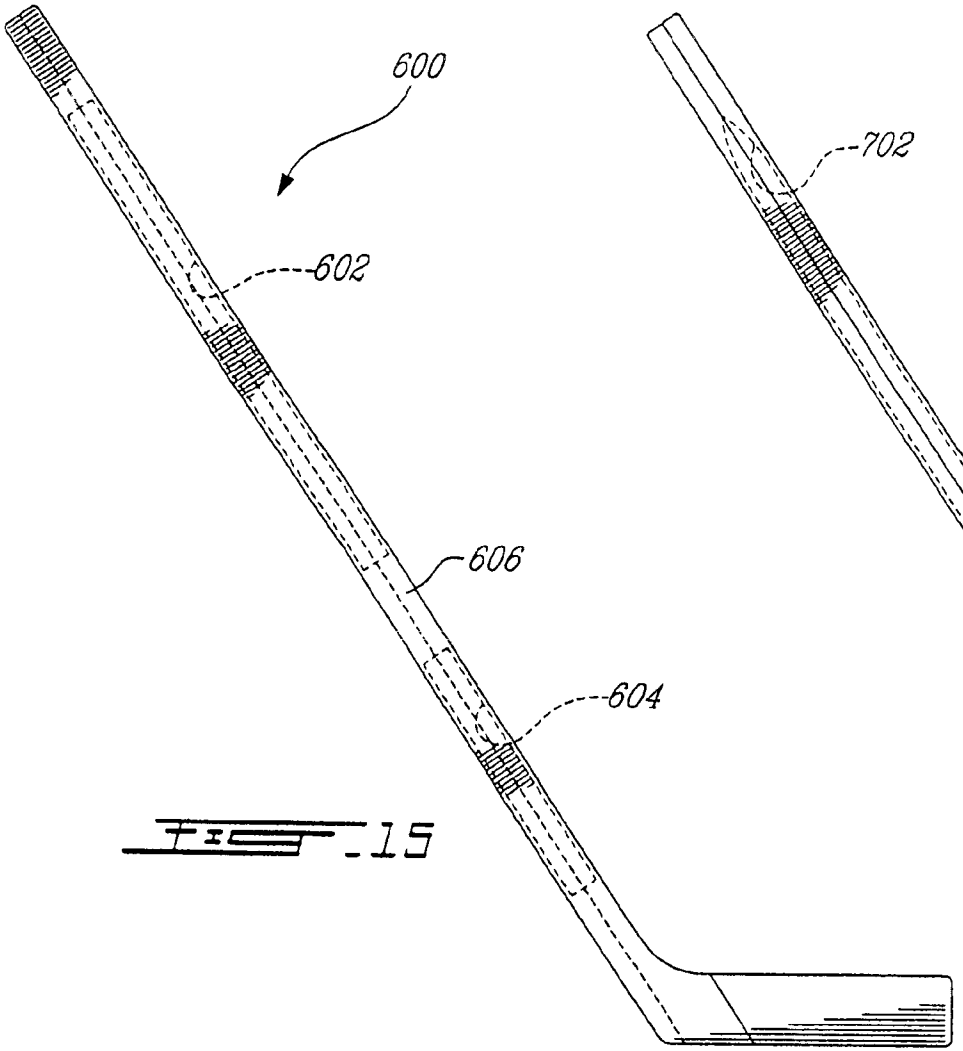
FIG. 15 is a schematic side elevational view of a hockey stick according to a seventh embodiment of the present invention.
Figure 17:
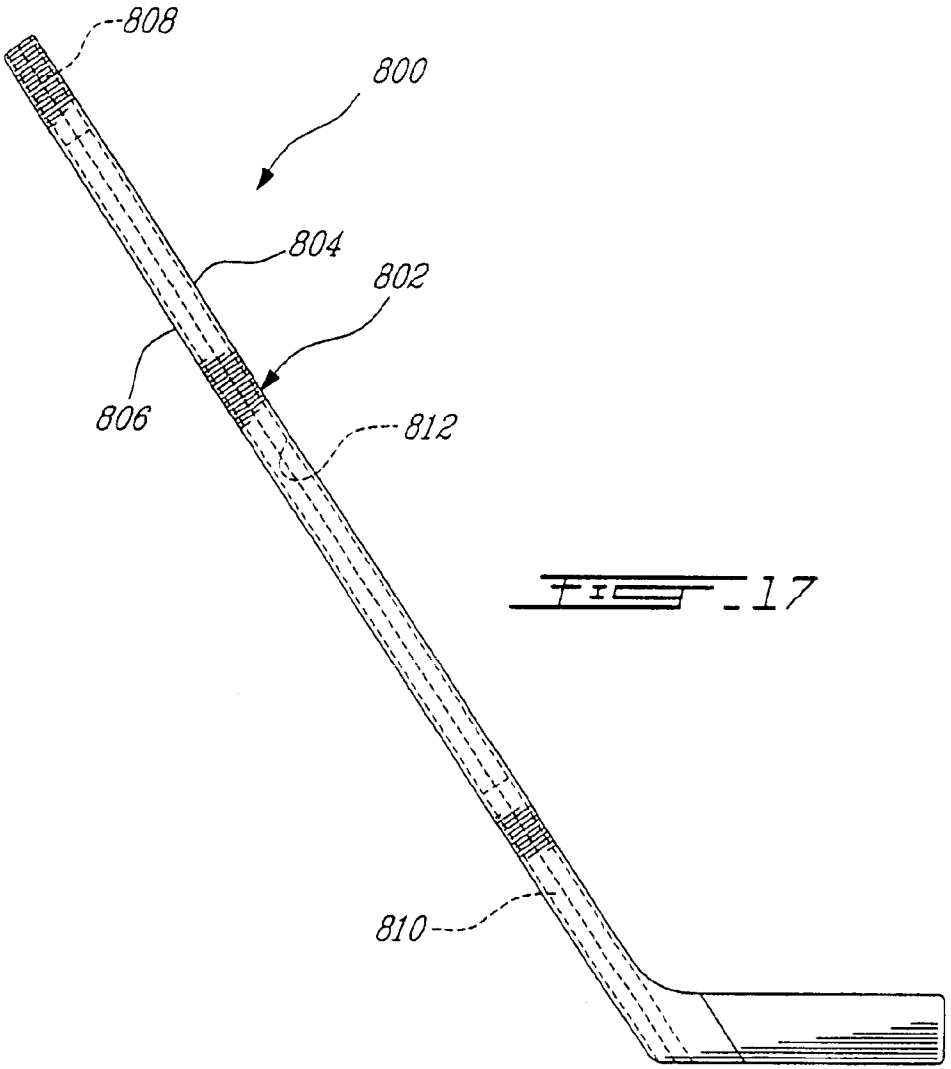
FIG. 17 is a schematic side elevational view of a hockey stick according to a ninth embodiment of the present invention.

Turning now to FIGS. 15 to 17 of the appended drawings, other embodiments of the present invention, illustrated by side elevational views, will be described.

FIG. 15 of the appended drawings illustrates a hockey stick 600 according to a seventh embodiment of the present invention. The major difference between the hockey stick 600 of FIG. 15 and the hockey stick 20 of FIGS. 1 and 2 is the fact that hockey stick 600 includes two cavities 602 and 604 leaving an intermediate solid portion 606 positioned where the user usually positions a hand. The manufacture of the stick 600 is very similar to the manufacture of stick 20 illustrated in FIGS. 3 to 8.

Similarly, FIG. 16 illustrates a hockey stick 700 according to a eighth embodiment of the present invention. The hockey stick 700 is very similar to the hockey stick 600 of FIG. 15 since they both are provided with two cavities. However, since the cavities 702 and 704 of the hockey stick 700 are made with a circular saw type machine, they have rounded end portions defined by the diameter of the saw used. Again, the manufacture of the hockey stick 700 is very similar to the manufacture of stick 20 illustrated in FIGS. 3 to 8.

Of course, the hockey sticks 600 and 700 respectively illustrated in FIGS. 15 and 16 could be constructed according to the arrangements illustrated in any of FIGS. 10 to 14.

FIG. 17 of the appended drawings illustrates a hockey stick 800 according to a ninth and final embodiment of the present invention. Again, the hockey stick 800 includes a shaft 802 made of two half-cores 804 and 806. However, the channel made in each half-core is not stopped at the proximate and distal ends of the shaft 802 but is continuous on the entire length thereof.

To reinforce the proximate and distal ends of the shaft 802, plugs 808 and 810 are inserted and glued in the cavity 812 defined by the channels of the half-cores.

The plug 810 could be made of a type of wood stronger and more wear resistant that the wood used to form the half-cores 804 and 806 for improved structural characteristics in the blade area. Conversely, the plug 808 could advantageously be made of high density material such as oak wood or other high density non wood material to shift the center of gravity of the hockey stick 800 away from the blade for improved balance. Of course, other materials could be used to make the plugs 808 and 810.

As will be understood by one skilled in the art, the machining of the half-cores 804 and 806 is simpler, and therefore less expensive, since the channels are provided in the entire length of the half-cores. Furthermore, this construction allows the flexibility to insert other plugs (not shown) in the cavity 812 to thereby allow the inexpensive construction of custom hockey sticks. Of course, the plugs 808 and 810 could advantageously be installed before the two half-cores are assembled.

As will be apparent to one skilled in the art, hockey sticks provided with L-shaped half-cores (see FIGS. 12 and 13) are advantageously provided with plugs as illustrated in FIG. 17 to simplify the production of the L-shaped half-cores.

It is to be noted that while the above description of the hockey stick has been directed to an ice hockey stick, other types of hockey sticks, for example to be used onto other hockey playing surfaces, could be constructed according to the method described hereinabove without departing from the present invention.

Although the present invention has been described hereinabove by way of preferred embodiments thereof, it can be modified, without departing from the spirit and nature of the subject invention as defined in the appended claims.

What is claimed is:

1. A method for making a shaft of a hockey stick, comprising the steps of:

providing two longitudinal rectangular wooden half-cores having a proximate end portion, a distal end portion and a central portion;

for each half-core, machining a channel in at least the central portion thereof;

assembling the machined half-cares face-to-face to thereby yield a hollow wooden core provided with a cavity in at least a central portion thereof, the assembled machined half-cores defining a joint therebetween; and mounting a joint reinforcement layer to the hollow wooden core so that the joint reinforcement layer reinforces the joint between the two half-cores, said channel machining step including machining a generally semi-cylindrical channel.

2. The method for making a shaft of a hockey stick as recited in claim 1, wherein said joint reinforcement layer mounting step includes mounting a relatively thin reinforcement strip on either opposite wider faces of the hollow wooden core.

3. The method for making a shaft of a hockey stick as recited in claim 1, wherein said machined half-core assembling step includes applying an adhesive to the half-cores.

4. The method for making a shaft of a hockey suck as recited in claim 1, wherein said joint reinforcement layer mounting step includes applying an adhesive to at least one of the joint reinforcement layer and the hollow wooden core.

5. The method for making a shaft of a hockey stick as recited in claim 1, wherein said joint reinforcement layer mounting step includes mounting a cylindrical tube in the longitudinal semi-cylindrical channels of the half-cores.

6. The method for making a shall of a hockey stick as recited in claim 1, wherein said wooden half-cores providing step includes providing wooden half-cores made of wood selected from the group consisting of aspen and poplar.

* * * * *